United States Patent [19]

Collins

[11] Patent Number: 5,065,534

[45] Date of Patent: Nov. 19, 1991

[54] STUDS FOR FOOTWEAR

[75] Inventor: Roy S. Collins, Sutton Coldfield, England

[73] Assignee: Trisport Ltd., Tamworth, England

[21] Appl. No.: 51,267

[22] Filed: May 5, 1987

Related U.S. Application Data

[63] Continuation of Ser. No. 760,319, Jul. 29, 1985, abandoned.

[30] Foreign Application Priority Data

Jul. 27, 1984 [GB] United Kingdom ..... 8419182

[51] Int. Cl.[5] ..... A43B 5/00; A43C 15/16

[52] U.S. Cl. ..... 36/134; 36/127; 36/67 D

[58] Field of Search ..... 36/134, 59 R, 67 R, 36/67 D, 127

[56] References Cited

U.S. PATENT DOCUMENTS

| | | | |
|---|---|---|---|
| 2,223,794 | 12/1940 | Pierce et al. | 36/67 D |
| 2,258,734 | 10/1941 | Brady | 36/134 |
| 2,470,997 | 5/1949 | McKenzie | 36/67 D |
| 2,784,503 | 3/1957 | Anderson | 36/127 |
| 2,862,312 | 12/1958 | Melchiona | 36/67 A |
| 3,010,229 | 11/1961 | Snitzer | 36/127 |
| 3,553,858 | 1/1971 | Austin | 36/134 |
| 3,597,864 | 8/1971 | MacNeill | 36/67 D |
| 3,638,337 | 2/1972 | Dollar, Jr. | 36/67 R |
| 4,299,038 | 11/1981 | Epple | 36/67 D |
| 4,360,490 | 11/1982 | Collins | 264/249 |
| 4,587,748 | 5/1986 | Collins | 36/127 |

FOREIGN PATENT DOCUMENTS

| | | | |
|---|---|---|---|
| 223894 | 3/1958 | Australia | 36/127 |
| 7529902.4 | 9/1975 | Fed. Rep. of Germany | |
| 1263960 | 2/1972 | United Kingdom | 36/67 A |
| 2098457 | 11/1982 | United Kingdom | 36/134 |
| 2115683 | 9/1983 | United Kingdom | 36/127 |

*Primary Examiner*—Steven N. Meyers

*Attorney, Agent, or Firm*—Oldham & Oldham Co.

[57] ABSTRACT

It is known to provide studs having externally screw-threaded spigots which are screwed into sockets provided in the soles of articles of footwear. In use, lateral forces applied to the ground-engaging portion of such a stud tend to damage the associated socket, particularly if the socket is made of a plastics material. To resist radially outward expansion of the socket the invention provides retaining means spaced outwards from the spigot. The retaining means may consist of a retaining ring with a flared bearing surface. The presence of the retaining means may render a split socket usable; also it may assist in preventing an otherwise loose stud becoming inadvertently unscrewed.

17 Claims, 3 Drawing Sheets

STUDS FOR FOOTWEAR

This invention relates to studs for footwear and in particular to studs of the kind that can be removed and replaced at will.

Shoes and other articles of footwear for use in various games, sports and other activities are often provided with studs to prevent or reduce the tendency for them to slip on the ground. The studs may be of various shapes and sizes, for example they may be relatively blunt, with flat or rounded ends, or more sharp, like spikes. For convenience of description they are herein referred to generically as studs.

Various forms of removable and replaceable studs have been previously proposed. One common form has a ground-engaging portion and an externally screw-threaded spigot which can be screwed into an internally screw-threaded socket in the undersurface of an article of footwear.

Screw-threaded sockets provided in articles of footwear may be of various forms, but the present invention is particularly concerned with preformed sockets incorporated in articles of footwear and of the kind comprising an internally screw-threaded barrel, open at its lower end for receiving an externally screw-threaded spigot on a stud. A plurality of separately formed, individual sockets may be incorporated in a sole or heel of an article of footwear, or a unitary insert including a plurality of sockets may be incorporated in a sole or heel of an article of footwear. Examples of one kind of insert, comprising a unitary moulding of a flexible plastics material, and including a plurality of sockets, are disclosed in the specification of published British Patent Application No. 2 115 683 A of Triman Limited.

A problem commonly experienced with studded footwear is that sockets in the form of internally screw-threaded barrels, particularly sockets formed of plastics materials, sometimes split when they are subjected to excessive forces, either when the footwear is in use, or as studs are screwed into the sockets. After a socket has split it is usually no longer capable of retaining a stud screwed into it, so that the socket is useless. The splitting of a single socket can thus render useless a pair of shoes or other articles of footwear. The splitting of a socket can occur when a lateral force is applied to the ground-engaging portion of a stud or when a stud is excessively tightened into the socket so that the socket is subjected to axial compression. It has been found that when the barrel of a socket is axially compressed it yields axially to some extent but the mouth of the socket tends to open radially outwards, and it is this that usually leads to a socket splitting.

When a socket splits, it tends to split along a line of weakness in the wall of the barrel. In a socket moulded from a plastics material, lines of weakness in the moulded socket, parallel with the axis of the socket, may arise where two streams of plastics material have met each other in the moulding process and failed to merge properly—a phenomenon known as "cold-shutting". Various expedients have been used to overcome or reduce the problem of "cold-shutting" but none has proved wholly successful. This problem therefore increases the likelihood of a socket splitting if it is misused.

One aim of the present invention is to provide a stud which, in use with an article of footwear, reduces the likelihood of a socket in the article splitting.

From one aspect the present invention consists in a stud for use with an article of footwear, the stud having an externally screw-threaded spigot, for engagement in an internally screw-threaded socket, open at its lower end, in an undersurface of the article of footwear, and retaining means spaced outwards from the spigot and operative in use to resist radially outward expansion of the socket.

For convenience of description articles of footwear, sockets, studs and other parts all described throughout this description and the appendant claims in the positions they take up when they are in use and the article of footwear is being worn by someone standing on a horizontal surface. Terms such as lower and undersurface must therefore be construed accordingly.

In use, the retaining means co-operates with a part of the socket in such a manner as to resist radially outward expansion of the socket, thereby reducing the tendency for the socket to split when a stud is screwed in too tightly or when a strong lateral force is applied to the ground-engaging portion of the stud. Preferably, the retaining means co-operates with a part of the socket surrounding the mouth of the socket so that expansion or enlargement of the mouth of the socket is resisted.

In use, where a socket is incorporated into the material of the undersurface, the retaining means preferably engages or is capable of engaging part of the socket directly, though it might preferably in some designs be possible for some material or component to be interposed between the retaining means and the socket.

The stud preferably includes a lower portion from which the spigot extends upwards, the lower portion presenting an upwardly directed annular face such that in use at least a portion thereof abuts an undersurface of an article of footwear, the retaining means comprising at least one rib or projection upstanding from said annular face. While the retaining means may comprise spaced ribs or projections upstanding from said annular face, the retaining means preferably comprises an annular retaining ring surrounding the spigot of the stud and spaced outwards from the spigot. An inner bearing face of the retaining ring is preferably of upwardly flared shape. The arrangement is preferably such that in use that resistance to the expansion of the socket is exerted through that flared inner face. Preferably the stud is so shaped that said annular face is of concave shape and the retaining means does not project above the level of the uppermost part of said annular face.

Although the retaining means preferably comprises an annular retaining ring presenting an inner bearing surface, it would be possible to provide retaining means in the form of an annular step or groove in an upwardly directed annular face of a lower portion of the stud, the step or groove affording an inner bearing surface.

Said lower portion of the stud preferably comprises an outwardly directed flange below which there projects a ground-engaging portion rf the stud but it could comprise a ground-engaging boss, the top of which presents said upwardly directed annular face.

The screw-thread on the spigot preferably has a downwardly facing bearing surface which is a flat bearing surface, that is a bearing surface so shaped that in any cross-section of the screw-thread containing the axis of the screw-thread the surface appears as a straight line normal or substantially normal to that axis.

From another aspect the present invention consists in a stud in accordance with said one aspect of the present invention in combination with an internally screw-threaded socket into which said spigot can be screwed, the retaining means then being operative to resist radially outward expansion of the socket.

An embodiment of the present invention will now be described, by way of example, with reference to the accompanying drawings, in which.

Figure 1:
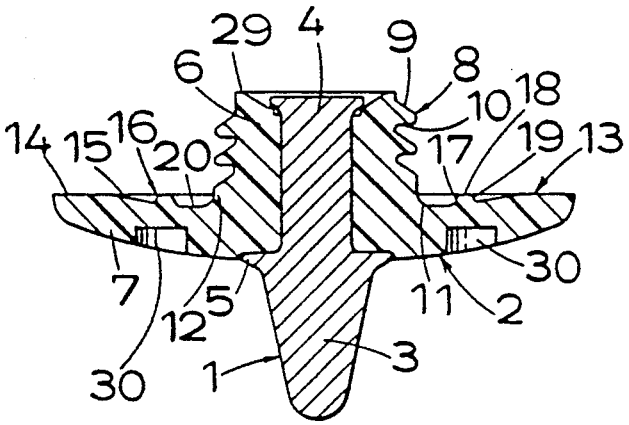
FIG. 1 is a section through a stud in accordance with the invention for an article of footwear.

The stud shown in FIG. 1 consists of two parts; a central steel pin 1 and an outer plastics moulding 2. The lower part of the pin 1 is shaped to provide a ground-engaging portion 3 of the stud, while the upper part of the pin 1 constitutes a rivet 4. The pin also includes an outwardly directed narrow flange 5 between the parts 3 and 4.

The plastics moulding 2 comprises an externally screw-threaded spigot 6 and an outwardly directed flange 7. In manufacture, the pin 1 and the moulding 2 are formed separately. During assembly the rivet 4 is inserted into the spigot 6 and riveted over to retain the moulding 2 in place against the narrow flange 5 on the pin 1. This type of construction is the subject of British Patent No. 2 028 102 of Triman Limited and is described in more detail in the specification of that patent. The moulding 2 may be made from any suitable plastics material, such as an acetal resin.

The screw-thread 8 of the spigot 6 is of a form similar to that described in the specification of published British Patent Application No. GB 2 115 683 A, also of Triman Limited, in that it has one inclined bearing surface 9 and one flat bearing surface 10 as defined in that specification. Thus a flat bearing surface is one that is so shaped that in any cross-section of the screw-thread containing the axis of the screw-thread the surface appears as a straight line normal or substantially normal to that axis; the generatrix of the flat bearing surface is preferably at no more than 5° to the normal, a particularly preferred inclination from the normal being 3°.

However, the stud differs from the stud illustrated in the specification of the above-mentioned patent application in that the screw-thread 8 on the spigot 6 terminates a short distance away from the flange 7, there being a portion 11 of arcuate section at the lower end 12 of the spigot 6 which merges into the flange 7. The arcuate portion 11 is provided to reduce the possibility of the screw-threaded spigot 6 shearing off from the flange 7 in the event of the stud being subjected to excessive forces in use.

The outwardly directed flange 7 of the plastics moulding 2 has an upwardly directed annular surface 13. An outer portion 14 of the surface 13 is of annular, planar shape, and an inner portion 15 thereof is of concave shape and is gently inclined downwardly and inwardly from the outer portion 14 to the arcuate portion 11 at the lower end 12 of the spigot 6. The underside of the flange 7 is of convex shape and is formed with a pair of diametrically opposed blind holes 30 for engagement by a ring spanner.

The stud is characterised in that there is provided an annular retaining ring 16 on the flange 7 upstanding from the inner portion 15 of the surface 13 and spaced outwards from the spigot 6. The annular retaining ring 16 has an inner surface, or bearing surface, 17 which is upwardly flared, the surface being of frusto-conical shape, with its generatrix inclined at about 15° to the vertical. The top 18 of the retaining ring is planar and the outer surface 19 of the ring is cylindrical. The ring 16 lies no higher than the outer portion 14 of the surface 13 of the flange 7. The height of the ring 16 from the inner portion 15 of the upper surface 13 is preferably such that its planar top 18 is substantially level with the peripheral portion 14 or is slightly lower than that portion. The annular retaining ring 16 and the arcuate portion 11 at the lower end of the spigot 6 together define an annular well 20 in the flange 7 around the spigot 6.

In one particular construction the maximum depth of the well 20 in the flange 7 is 0.02 inches (0.508 mm) and the height of the annular ring 16 above the flange 7 is 0.015 inches (0.381 mm).

Figure 2:
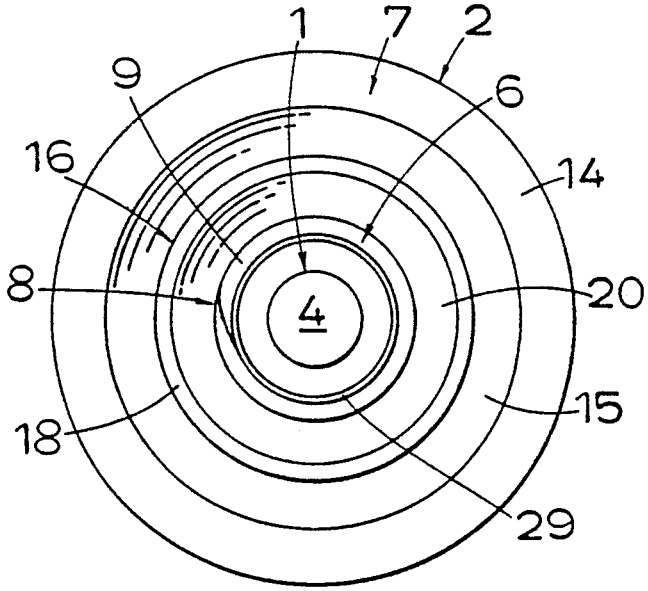
FIG. 2 is a plan of the stud of FIG. 1.
Figure 3:
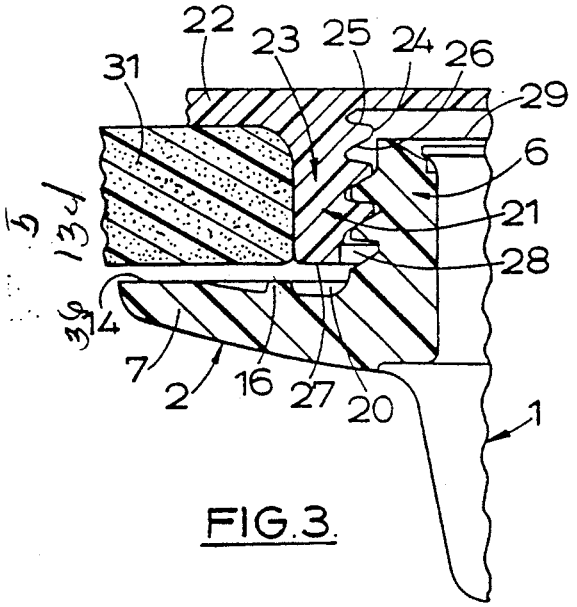
FIG. 3 is an enlarged scrap section showing the stud of FIG. 1, in use, partly engaged with a socket in an article of footwear.
Figure 4:
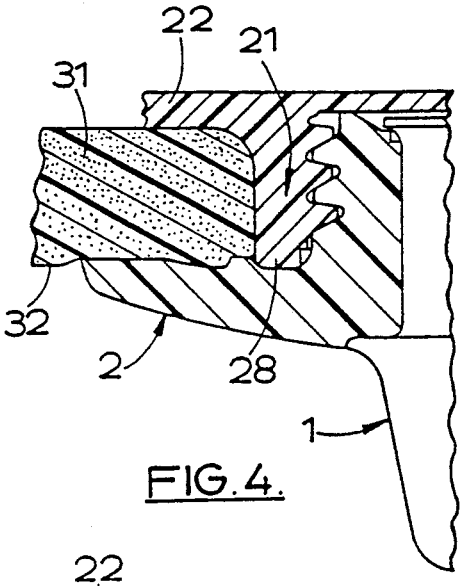
FIG. 4 is a section similar to FIG. 3 but showing the stud almost fully engaged with the socket.
Figure 5:
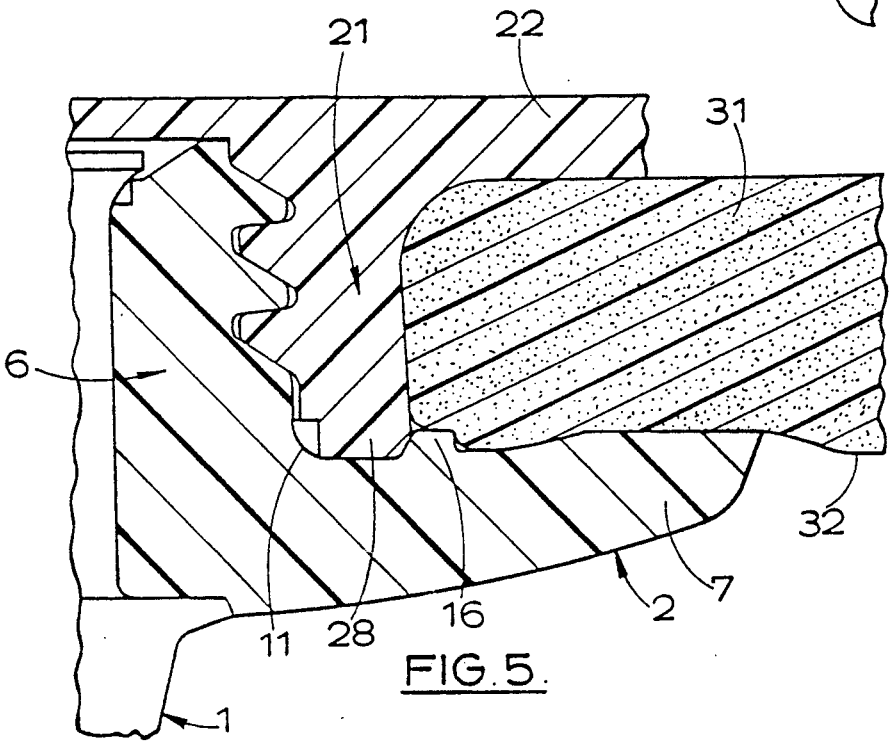
FIG. 5 is a scrap section, to a still larger scale, of other parts of the same stud and socket, with the stud fully engaged with the socket.
Figure 6:
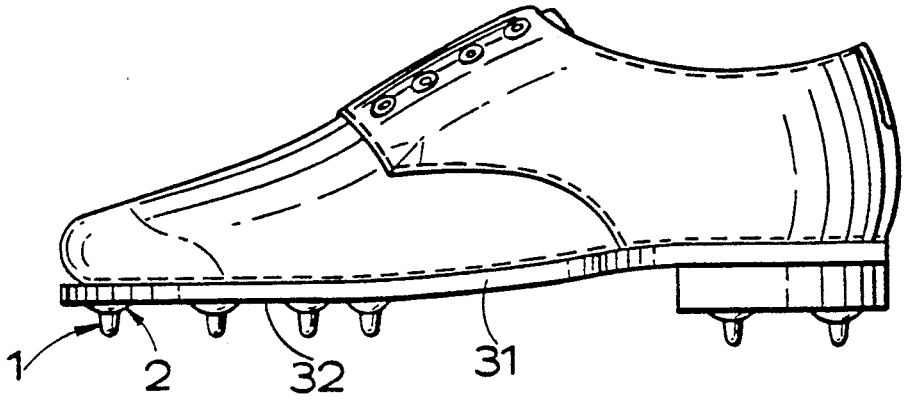
FIG. 6 is a side view, to a smaller scale, of a golf shoe provided with studs in accordance with the invention.

FIGS. 3, 4 and 5 are enlarged part sections of the stud of FIGS. 1 and 2, in use, being screwed into a socket 21 in the sole of an article of footwear, such as a golf shoe.

The socket 21 is formed from a moulded plastics material, desirably the same material from which the plastics moulding 2 of the stud is formed, and comprises a cylindrical barrel 23 depending from a horizontal plate 22. The inside surface of the barrel 23 is provided with a screw-thread 24 that is complementary to the external screw-thread 8 on the spigot 6 of the stud. Thus the screw-thread 24 has one generally flat bearing surface 25 and one inclined bearing surface 26. The screw-thread 24 terminates before the lower end 27 of the barrel 23, leaving an annular lip 28 which projects downwards below the level of the screw-thread and surrounds the mouth of the socket 21.

Part of the sole 31 of the article of footwear is shown in FIGS. 3, 4 and 5. The socket 21 is set into the material of the sole so that the lower end 27 of the barrel 23 is substantially flush with the undersurface 32 of the sole. In a modified arrangement (not illustrated) the lower end 27 of the barrel 23 is inset very slightly into the sole 31 so as to be a little above the level of the undersurface 32.

In FIG. 3 the stud is shown partly screwed into the socket 21, in a position in which the annular lip 28 of the barrel 23 is just about to enter the annular well 20 between the spigot 6 and the annular ring 16 on the flange 7 of the stud.

In FIG. 4 the stud is shown almost fully screwed into the socket 21 so that an upper end surface 29 of the spigot 6 is substantially in contact with the plate 22 which closes the upper end of the socket 21, while the lip 28 is received in the annular well 20. In this position, the outer portion 14 of the annular surface 13 of the flange 7 engages the undersurface of the sole in such a manner that the sole and the flange 7 yield resiliently to form a seal.

At this stage the lower end 27 of the barrel 23 abuts the bottom of the well 20 but the outer surface of the barrel does not abut more than a lower edge of the bearing surface 17 of the retaining ring 16.

A slight additional rotation of the stud brings the stud and socket into the fully engaged state as shown in FIG. 5. The forces exerted on the barrel 23 by the screw-thread 8 of the stud causes the barrel to become deformed to a very small extent so that a lower end part of the barrel is forced resiliently outwards whereby more of the outer surface of the barrel abuts the bearing surface 17.

In practice the stud may be tightened to any degree of tightness between that of FIG. 4 and that of FIG. 5. Nevertheless, in each case the provision of the retaining ring 16 serves to prevent radially outward expansion of the socket. When the article of footwear is in use it is likely that considerable forces are from time to time applied to the stud. Some of them may well tend to cause outward expansion of at least part of the socket, and such expansion is again resisted by the retaining ring. Any tendency that there might otherwise have been for the barrel to split is strongly resisted by the retaining ring.

The sole may be made from any suitable material, such as leather or a plastics material, but is preferably made from a material that is less hard than the material from which the plastics moulding of the stud is formed. Therefore, when the stud is being screwed into place the annular ring 20 is able to press back the material of the sole surrounding the socket 21 and to engage the outer surface of the barrel 23. This is clearly illustrated in FIGS. 4 and 5.

The stud described above is illustrated as being used with a socket with an unbroken barrel. A further advantage of the present invention is that it is often possible for a stud having retaining means such as the ring 16 to be used with a socket that has a barrel that is already formed with a vertical split. When a stud is tightened to the fully engaged position in the split barrel, the retaining means engages the outer surface of the barrel to resist expansion of the barrel and to help prevent the split from opening when the article of footwear incorporating that split barrel is in use. In this way it is often found that the stud can be held securely in place in the split barrel.

Another advantage of the invention arises in the following circumstances. It sometimes happens that as a result of slight variations in manufacture the size of the screw-thread on a stud is slightly less than that required for secure engagement in a particular socket in which it is desired to mount the stud. Normally the only way of securing such a stud in place has been to screw the stud fully into the socket so that it is held in place by frictional engagement between the outer portion of the flange and the undersurface of the sole. A conventional stud, however, may still gradually work loose. As soon as there is no frictional engagement between the flange and the undersurface of the sole the stud can readily become unscrewed and either become detached from the socket or, while partially projecting from the socket, lead to the barrel being split. However when a stud having an undersized screw-thread and also provided with retaining means is screwed tightly into a socket, it is found that in many instances a more positive screw-threaded engagement between the stud and socket is obtained. The reason for this is not entirely clear. Nevertheless the effect is such that if an attempt is subsequently made to unscrew the stud, there is found to be frictional engagement between the stud and socket throughout the entire range of threaded engagement between the stud and the barrel. This suggests that some permanent deformation occured when the stud was initially inserted and when the retaining means first pressed against the barrel.

It will be appreciated that various modifications may be made to the stud described above while still falling within the scope of the present invention. For example, the annular retaining ring 16 may be replaced by a series of circumferentially spaced ribs or projections or by a portion of the flange bordering an annular groove, the arrangement being such that in use the lip 28 on the barrel 23 enters the groove. Outward expansion of the barrel is restrained by engagement with a portion of the flange defining the outer wall of the groove.

We claim:

1. A stud for use with an article of footwear, said stud comprising a pin having a ground-engaging lower portion and an upper portion, and a one-piece molded plastic member surrounding the upper portion of said pin and lockingly engaging the same, said one-piece plastic member comprising an externally screw-threaded spigot and an outwardly extending flange at the lower end thereof, said flange having an upper surface extending outward to contact a footwear sole when the spigot is screwed into a socket in said sole, said upper surface having an annular well adapted to receive a lower end of a socket, an outer edge of said annular well being formed by a retaining means spaced outward from said pin and inboard from an outer edge of said upper surface of said flange to restrain spreading of the lower end of said socket due to contact with said retaining means.

2. A stud according to claim 1 in which the retaining means comprises an annular retaining ring surrounding the spigot of the stud and spaced outward from the spigot.

3. A stud according to claim 2 in which an inner bearing face of the retaining ring is of upwardly flared shape.

4. A stud according to claim 1 in which an inside face of said annular well is of concave shape and the retaining means does not project above the level of the uppermost part of said face.

5. A stud according to claim 1 in which a lower portion of the pin comprises an outwardly directed flange below which projects a ground-engaging portion of the pin.

6. A stud according to claim 1 in which the screw-thread on the spigot has a downwardly facing bearing surface which is a flat bearing surface, that is a bearing surface so shaped that in any cross-section of the screw-thread containing the axis of the screw-thread the surface appears as a straight line normal or substantially normal to that axis.

7. A stud according to claim 1 in combination with an internally screw-threaded socket into which said spigot can be screwed, the retaining means then being operative to resist radially outward expansion of the socket.

8. The combination of a stud and socket for use with an article of footwear having a ground-engaging undersurface, the stud having an externally screw-threaded deformed spigot of which a lower end part is surrounded by an annular well bounded at an outer side thereof by retaining means spaced outwards from the spigot, and the socket comprising an internally screw-threaded barrel, made of a plastics material, which is open at its lower end, and being adapted for incorporation into an article of footwear so that the interior of said barrel is accessible through an aperture in said undersurface, said spigot being capable of entry into said barrel through said lower end thereof and capable of being screwed into said barrel until a lower end part of said barrel enters said well, radially outward expansion of said lower end part of the barrel, such as results from the tightening of the spigot in the socket, being resisted by engagement between said lower end part of the barrel and said retaining means.

9. The combination of a stud and socket according to claim 8, in which said lower end part of said barrel is not internally screw-threaded.

10. The combination of a stud and socket according to claim 8 in which the retaining means comprises a continuous annular retaining ring surrounding the spigot of the stud and spaced outwards from the spigot.

11. The combination of a stud and socket according to claim 10 in which an inner bearing face of the retaining ring is of upwardly flared shape.

12. The combination of a stud and socket according to claim 8 in which said annular face is of concave shape and the retaining means does not project above the level of the uppermost part of said annular face.

13. The combination of a stud and socket according to claim 8 in which said lower portion of the stud comprises an outwardly directed flange below which there projects a ground-engaging portion of the stud.

14. A combination of a stud and socket according to claim 11 in which the screw-thread on the spigot has a downwardly facing flat bearing surface so shaped that in any cross-section of the screw-thread containing the axis of the screw-thread the surface appears as a straight line normal or substantially normal to that axis and the screw-thread in the barrel is of complementary shape.

15. The combination of a stud and socket according to claim 8 in which said spigot is made of a plastic material.

16. A combination of a stud and socket according to claim 8 in which the stud includes a pin having a ground engaging lower portion and an upper portion, said upper portion being received in said spigot.

17. An article of footwear incorporating a plurality of studs and sockets each of which is in accordance with claim 8.

* * * * *